US010608343B2

(12) United States Patent
Tankielun et al.

(10) Patent No.: US 10,608,343 B2
(45) Date of Patent: Mar. 31, 2020

(54) ANTENNA SYSTEM

(71) Applicant: Rohde & Schwarz GmbH & Co. KG, Munich (DE)

(72) Inventors: Adam Tankielun, Ottobrunn (DE); Thomas Rossberger, Geiersthal (DE); Ali Bouraffa, Hamburg (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 218 days.

(21) Appl. No.: 15/700,006

(22) Filed: Sep. 8, 2017

(65) Prior Publication Data

US 2019/0081408 A1 Mar. 14, 2019

(51) Int. Cl.

| | |
|---|---|
| ***H01Q 19/09*** | (2006.01) |
| ***H01Q 19/06*** | (2006.01) |
| ***H01Q 13/08*** | (2006.01) |

(52) U.S. Cl.

CPC ..... *H01Q 19/09* (2013.01); *H01Q 13/085* (2013.01); *H01Q 19/062* (2013.01)

(58) Field of Classification Search

CPC ..... H01Q 19/06; H01Q 19/09; H01Q 13/085; H01Q 19/062

USPC ..... 343/753

See application file for complete search history.

(56) References Cited

U.S. PATENT DOCUMENTS

| | | | | |
|---|---|---|---|---|
| 5,952,984 | A * | 9/1999 | Kuramoto | H01Q 19/08 343/911 R |
| 9,882,277 | B2 * | 1/2018 | Henry | H01P 3/16 |
| 2012/0088459 | A1 * | 4/2012 | Neto | H01Q 1/38 455/73 |
| 2015/0207236 | A1 * | 7/2015 | Felic | H01Q 1/3233 343/753 |
| 2016/0087344 | A1 * | 3/2016 | Artemenko | H01Q 15/08 343/753 |

* cited by examiner

*Primary Examiner* — Huedung X Mancuso
(74) *Attorney, Agent, or Firm* — Christensen O'Connor Johnson Kindness PLLC

(57) ABSTRACT

An antenna system is described, comprising at least one antenna element provided on a printed circuit board material and a lens unit with a lens body made of a dielectric material, the lens unit being directly connected to the antenna element. The lens unit comprises a lower side facing the antenna element and an upper side being located opposite to the lower side. Further, the upper side has at least one of a convex surface and a Fresnel lens shaped surface. The lens unit also comprises at least one recess filled by the antenna element in a mounted state of the antenna system.

19 Claims, 2 Drawing Sheets

ANTENNA SYSTEM

TECHNICAL FIELD

Embodiments of the present disclosure relate to an antenna system for receiving and/or emitting electromagnetic waves having a certain wavelength.

BACKGROUND

In the state of the art, tapered slotline antennas (TSAs) are known which are used for determining and/or measuring radiation and signal characteristics of wireless devices over the air (OTA measurements). The tapered slotline antennas are also called Vivaldi antennas. For instance, such tapered slotline antennas can be used for testing devices under test (DUTs) such as communication devices in certain frequency ranges. Furthermore, such tapered slotline antennas are used for microwave imaging systems such as scanners used at security check points, for instance airports. Typically, tapered slotline antennas are used for ultra-wideband frequencies such as frequencies ranging from 3 to 85 GHz.

The tapered slotline antennas may be formed by a printed circuit board having a low thickness ensuring a broad field of application.

Generally, a tapered slotline antenna may comprise at least two antenna elements that are arranged perpendicular to each other in order to establish a dual-polarized antenna unit, for instance.

It is further known to combine the tapered slotline antenna with a lens establishing an antenna system with adapted radiation characteristics. Typically, the lens is assigned to the antenna element of the tapered slotline antenna via a holder. However, the lens used in the state of the art is relatively bulky which in combination with the additional holder results in a relatively narrowband performance of the overall antenna system.

Accordingly, there is a need for an antenna system having good radiation performance, namely a high antenna gain resulting in an increased OTA measurement accuracy.

SUMMARY

Embodiments of the present disclosure provide an antenna system comprising at least one antenna element provided on a printed circuit board material and a lens unit with a lens body made of a dielectric material, the lens unit being directly connected to the antenna element. The lens unit in some embodiments comprises a lower side facing the antenna element and an upper side being located opposite to the lower side, the upper side having at least one of a convex surface and a Fresnel lens shaped surface. The lens unit in some embodiments also comprises at least one recess, wherein the antenna element is at least partly inserted into the recess in a mounted state of the antenna system.

Accordingly, the antenna system can be formed in a lightweight manner since the lens unit is directly attached to the antenna element without the need of a bulky holder which increases the weight of the antenna system. Since the lens unit is directly attached to the antenna element, the assembling of the antenna system is simplified resulting in lower costs. The recess provided in the lens body is filled by a part of the antenna element in the mounted state of the antenna system. In addition, the overall performance of the antenna system is improved due to the fact that the lens unit is directly attached to the antenna element without any additional holder. The performance of the antenna system is further improved due to the appropriately shaped upper side. Therefore, the measurement accuracy of the antenna system can be increased thanks to the higher antenna gain of the antenna system achieved by the shape of the lens unit, in particular its upper side having at least one of a convex surface and a Fresnel lens shaped surface. Particularly, the beam width and the directivity of the antenna system are increased in a respective frequency band.

In some embodiments, the recess is provided at the lower side of the lens unit facing the antenna element.

The lower side and the upper side of the lens unit are continuously formed which means that they are not provided by a circumferential rim.

In general, the lens unit made of a dielectric material may also be called dielectric lens.

According to an aspect, the lens unit is made in one piece. Thus, the lens unit comprises a single lens body having the lower side and the upper side. In these embodiments, the lens unit is not formed by a lens system having separately formed lens elements. In addition, the lens body is a solid body made of the dielectric material without any cavities. Thus, the lens body in these embodiments is a non-holed body without any cavity from one of its face sides. Accordingly, the lens body is not formed like a curved lens such as a contact lens for a human eye. The material thickness of the lens unit, for example the lens body, varies along a length axis, connecting the upper side and the lower side, of the lens body merely due to the shape of the upper side and (optionally) the one of the lower side. Therefore, the lens body is formed such that starting from an outer contour of the lens body, for example from an outer face being substantially perpendicular to the lower side and/or the upper side, towards the center of the lens body results in passing through the dielectric material of the lens body.

Further, the recess may be provided by a slot in the lens body. A slot is characterized by its typical relative dimensions as the length has a dimension being greater than the one of the width. Accordingly, the relative area used by the slot with respect to the overall lower side is relative small. The slot may have a shape, in particular width and length, corresponding to the antenna element, in particular a tip of the antenna element that is covered by the lens unit in the mounted state of the antenna system.

According to another aspect, the slot extends through the whole lens body at the lower side. Thus, the slot runs along the whole lower side such that the slot starts at a first end and ends at a second end being opposite to the first end. The first and second ends are inter alia located at an outer face being perpendicular to the lower side as the slot has a certain depth.

Moreover, the lens body may be dimensioned such that the contour of the lens body is substantially undisturbed by the slot and the antenna element filling the slot in the mounted state of the antenna system. Therefore, the lens body, in particular its slot, and the antenna element match with each other as the outer shape of the lens unit, for example the lens body, is not disturbed. In other words, the lens body has a cross section, in a direction perpendicular to its length axis, that substantially corresponds to the width of the antenna element, in particular the printed circuit board.

Accordingly, the antenna element and the lens unit establish a push fit fitting as the lens unit is put over the antenna element such that the antenna element is partly inserted in the recess, in particular a tip of the antenna element, namely a tip of the printed circuit board material. Accordingly, the antenna element merges into the lens body until it rests on an abutting surface provided by the recess.

In addition, a form-fit between the antenna element and the lens unit can be established by the slot at least for one direction being perpendicular to the length axis. Moreover, the abutting surface ensures another form-fit along the length axis. The abutting surface extends along the complete lens body.

In general, the recess providing the form-fit avoids that the lens unit can be shifted with respect to the antenna element inadvertently.

In other words, the form-fit established between the lens unit and the antenna element provides a positive-locking between both components of the antenna system.

Furthermore, the lower side may comprise at least one of a convex surface and a Fresnel lens shaped surface. Therefore, the lens body comprises at its opposite sides, namely the lower and the upper side, appropriate shaped surfaces for improving the radiation characteristics of the antenna system. The lower side that faces the antenna element improves the radiation characteristics as the electromagnetic waves radiated by the antenna element are collected appropriately.

Thus, the lens unit may be a bi-convex lens. As the lower side and the upper side are formed in an analog manner, the lens unit is symmetrical with respect to a symmetry plane intersecting the middle portion of the lens body.

Moreover, the focal point of the lens unit may be assigned substantially to the phase center of the antenna element in the mounted state. This ensures that the antenna gain is increased in an optimal manner.

Generally, the lens body may comprise a main portion defined by a cylinder, in particular a solid cylinder. Accordingly, the outer contour of the lens body is established by the shell surface of the cylinder. The base areas of the cylinder correspond to the upper side and the lower side that may be shaped appropriately. For instance, the cylinder is a circular cylinder.

According to an embodiment, the lens body has a rounded circumference. Thus, the lens body is substantially formed by a circular cylinder wherein the shell surface defines the circumference of the lens body.

According to another aspect, the lens body has a polygonal contour. Thus, the lens body is formed by a cylinder, in particular a solid cylinder, having a polygonal cross section.

Generally, the lens body has at least one straight surface at its outer contour due to the solid body. This straight surface extends from the upper side to the lower side.

The lens unit may be glued to the antenna element. This ensures a long lasting connection of the lens unit at the antenna element. The adhesive may be inserted into the recess prior to pulling the lens unit over the antenna element. Alternatively, the tip of the antenna element is covered with an adhesive such that the chemical connection is provided when the lens unit is put on the antenna element such that the tip of the antenna element is inserted into the recess. In both cases, the adhesive is provided between the tip of the antenna element and at least the abutting surface of the lens unit.

According to another aspect, the relative electric permittivity of the lens unit is lower than 3. In some embodiments, the relative electric permittivity is lower than 1.5. This ensures that the radiation performance of the antenna system is improved appropriately.

According to an embodiment, the antenna system comprises two antenna elements being orthogonal to each other such that a dual-polarized antenna unit is provided. The dual-polarized antenna unit is also called dual-orthogonal polarized antenna unit as both antenna elements are arranged substantially perpendicular with respect to each other. The performance characteristics of such a dual-polarized antenna unit are improved appropriately.

The lens unit may comprise two slots at its lower side, the slots intersecting each other at an angle being substantially 90°. Thus, the lens unit can be put on the antenna unit that comprises both antenna elements being orthogonal to each other. In other words, the lens unit fits to the antenna unit.

Furthermore, the lens unit is directly connected to both antenna elements. Both antenna elements, for example their tips, are inserted into the slots in a similar manner as described above. The aforementioned aspects are applicable mutatis mutandis.

Generally, the lens unit may be connected to both antenna elements by a chemical connection in addition to the mechanical connection already provided due to the form-fit. The form-fit is established by the recesses and the tips of the antenna elements inserted into the corresponding recesses. The from-fit is ensured for all directions in a plane being perpendicular to the length axis of the antenna element(s) or rather the antenna system. Typically, the length axis corresponds to the radiation direction of the antenna system.

Moreover, the antenna system may be a tapered slotline antenna. For instance, the tapered slotline antenna may be a dual polarized tapered slotline antenna.

According to another aspect, the antenna system comprises a feeding portion and a radiation portion, the lower side being assigned to the feeding portion, the upper side being assigned to the radiation portion.

Generally, the form-fit or rather positive-locking provided by both antenna elements and the lens unit additionally ensures that the individual antenna elements are maintained in their positions, for example orthogonally with respect to each other. Accordingly, the lens unit is a stabilization unit while stabilizing both antenna elements in more than one direction as already mentioned above. The individual antenna elements of the antenna unit may also called antenna wings due to their shape.

BRIEF DESCRIPTION OF DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawing, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
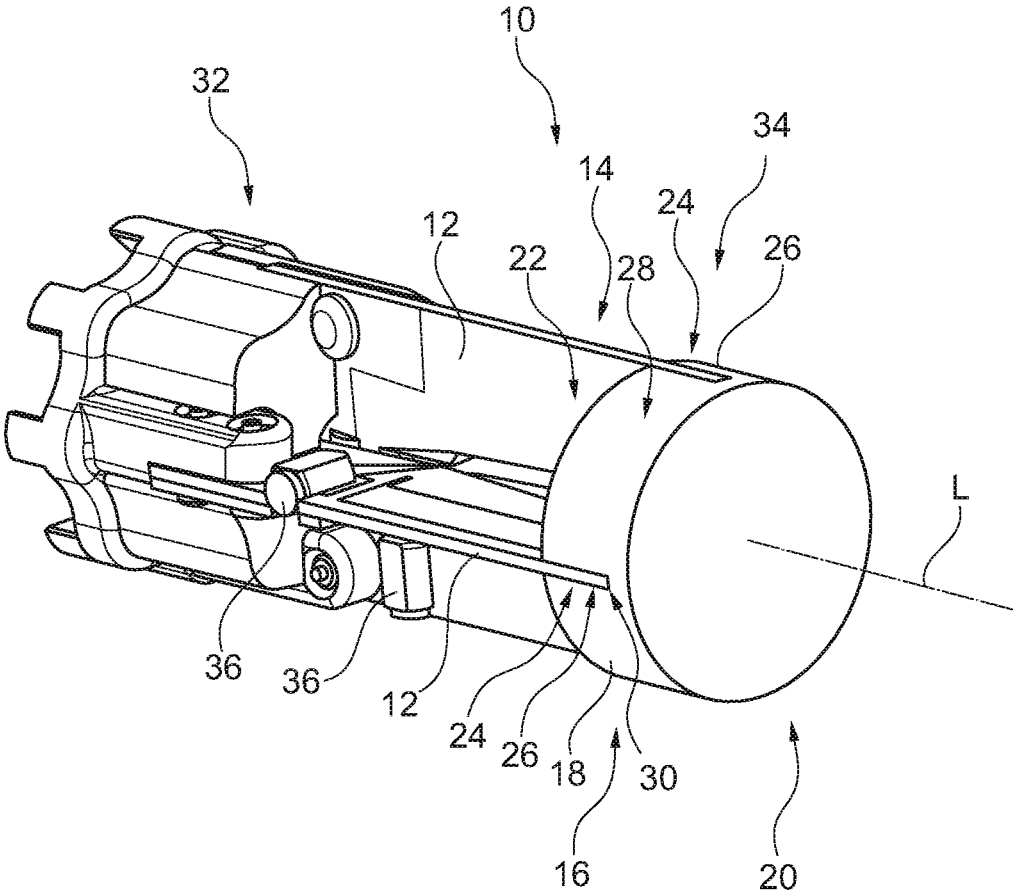
FIG. 1 shows a perspective view on an exemplary embodiment of an antenna system according to the disclosure.

In FIG. 1, an antenna system 10 is shown that comprises two antenna elements 12 that are arranged perpendicular to each other in order to establish a dual polarized antenna unit 14. The antenna unit 14, in particular the whole antenna system 10, is established by a tapered slotline antenna, namely a dual-polarized tapered slotline antenna. Thus, the individual antenna elements 12 are provided on a printed circuit board material (PCB material).

Those antenna elements 12 are commonly known wherein they each comprise conductive portions being axial symmetrical arranged with respect to each other wherein the axis is provided by the main direction of the antenna unit 14. Between the conductive portions of each antenna element 12, a so-called slot region is provided that separates both conductive portions. This is the reason why the antenna elements 12, in particular the whole antenna unit 14, are called tapered slotline antenna(s). Alternatively, the tapered slotline antennas are called Vivaldi antennas.

The antenna system 10 also comprises a lens unit 16 which comprises a lens body 18 made of a dielectric material. The lens body 18 is a solid body that is completely filled with the dielectric material. In the shown embodiment, the lens body 18 is established by a circular cylinder such that the lens unit 16, in particular the lens body 18, has a rounded circumference. Accordingly, the lens body 18 is established by a solid circular cylinder.

Further, the lens unit 16 comprises an upper side 20 and a lower side 22 being opposite to the upper side 20. The lower side 22 faces towards the antenna elements 12 whereas the upper side 20 faces away from the antenna elements 12 as shown in FIG. 1.

The whole lens unit 16, namely the lens body 18, is made in one piece such that the upper side 20 and the lower side 22 are part of the lens body 18. Particularly, the upper side 20 and the lower side 22 are established by the face sides of the lens body 18. Thus, the upper and lower sides 20, 22 correspond to the base areas of the circular cylinder formed by the lens body 18.

The upper side 20 comprises at least one of a convex surface and a Fresnel lens shaped surface that improves the radiation properties of the antenna system 10 appropriately. In the shown embodiment, the upper side 20 has a convex surface that faces away from the antenna elements 12. Due to this shape, the radiation characteristics such as directive and beam width are inter alia improved.

Figure 3:
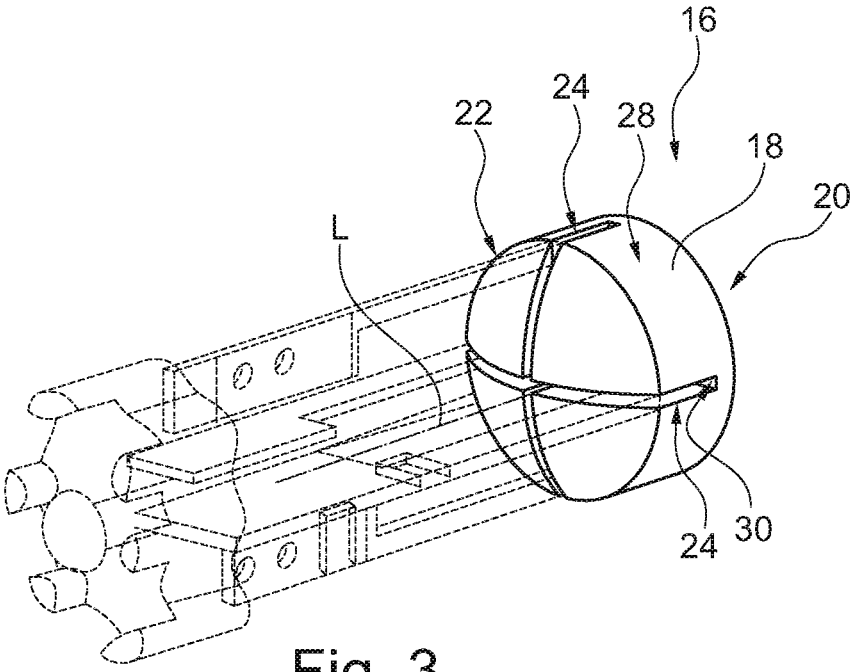
FIG. 3 shows a perspective view on a lens unit used by the antenna system of FIG. 1.

Further, as already shown in FIG. 1, the lower side 22 comprises at least one recess 24 that is filled by at least a tip 26 of the antenna element 12 in a mounted state of the antenna system 10. In FIG. 3, the lower side 22 of the lens unit 16 is shown in more detail. This figure reveals that the lower side 22 comprises two recesses 24 that intersect each other at a right angle, namely at substantially 90°. The recesses 24 are established by two slots that extend over the whole lower side 22 as shown in FIG. 3.

Accordingly, the recesses 24 extend from one end to an opposite end across the lower side 22. In fact, the recesses 24 start at the shell surface 28 of the cylinder and extend completely through the lens body 18 while intersecting the lens body 18 along an axis perpendicular to the length axis L of the lens body 18.

In general, the shell surface 28 is substantially parallel to the length axis L of the lens body 18 wherein the shell surface 28 extends from the upper side 20 to the lower side 22. Due to the recesses 24, the shell surface 28 is interrupted appropriately. However, this interruption or rather disturbance of the shell surface 28 is substantially equalized by the tips 26 of the antenna elements 12 in the mounted state such that the lens body 18 is substantially undisturbed at its outer contour. Accordingly, the diameter of the circular lens body 18 corresponds to width of the tip 26 of the antenna element 12.

The recesses 24, for example the slots, have a depth that corresponds to approximately the half of the thickness of the lens body 18. Generally, the depth of the recesses 24, for example the slots, ranges between 20% and 80% of the thickness of the lens body 18.

This depth of the recesses 24 ensures that the tips 26 of the antenna elements 12 are securely received by the recesses 24. As already mentioned, the tips 26 of the antenna elements 12 are inserted into the recesses 24 until they abut against an abutting surface 30 formed by the end of the recesses 24 along the length axis L: The abutting surface 30 extends in a similar manner as each of the recesses 24 along the whole lens body 18, in particular from one end to an opposite end across the lower side 22.

Due to the recesses 24, the lens unit 16 is mechanically connected to the antenna unit 14, for example the antenna elements 12, by a form-fit. The from-fit is ensured for all directions in a plane being perpendicular to the length axis L. Accordingly, the lens unit 16 can neither be (translationally) shifted nor turned with respect to the antenna unit 14. Therefore, it is avoided that the lens unit 16 is positioned out of the main direction of the antenna unit 14 inadvertently.

As both antenna elements 12, in particular their tips 26, are inserted into the respective recesses 24, the lens unit 16 also stabilizes the antenna system 10 due to the positive-locking. Thus, a relative movement of the antenna elements 12 with respect to each other is avoided.

In addition, a chemical connection may be provided between the lens unit 16 and the antenna unit 14, in particular the antenna elements 12, by providing an adhesive that connects the antenna element(s) 12, for example their tips 26, and the lens unit 16 in the area of the recesses 24 appropriately.

The abutting surfaces 30 of the recesses 24 may be coated with the adhesive prior to putting the lens unit 16 over the tips 26 of the antenna elements 12 such that these tips 26 get in contact with the adhesive for the chemical connection. Alternatively, the tips 26 are coated with the adhesive such that the chemical connection is established once the tips 26 of the antenna elements 12 are inserted into the recesses 24.

As shown in FIG. 3, the lower side 22 of the lens unit 16 may also have a convex surface or a Fresnel lens shaped surface such that the electromagnetic waves radiated are collected by the lens unit 16, in particular via the appropriately shaped lower side 22.

Accordingly, the lens unit 16 is a bi-convex lens that is attached to the antenna element(s) 12 directly without the need of any separately formed bulky holder.

Figure 4:
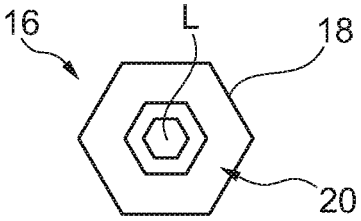
FIG. 4 schematically shows a front view on a lens unit used by another embodiment of an antenna system according to the disclosure.

As shown in FIGS. 1 and 3, the focal point of said lens unit 16 is assigned substantially to the phase center of said antenna unit 14 in the mounted state of the antenna system 10 such that the gain increase is maximum. Alternatively to the shown embodiment of FIGS. 1 and 3, the lens unit 16 may also have a polygonal contour such that the lens body 18 is a cylinder having a polygonal shape as shown in FIG. 4. The upper side 20 of that embodiment comprises a Fresnel lens shaped surface that is schematically depicted in FIG. 4.

The shell surface 28 of the lens unit 16 having a polygonal contour comprises at least one straight outer surface that is parallel to the length axis L wherein the straight outer surface extends from the upper side 20 (shown in FIG. 4) towards the lower side 22 of the lens unit 16.

Figure 2:
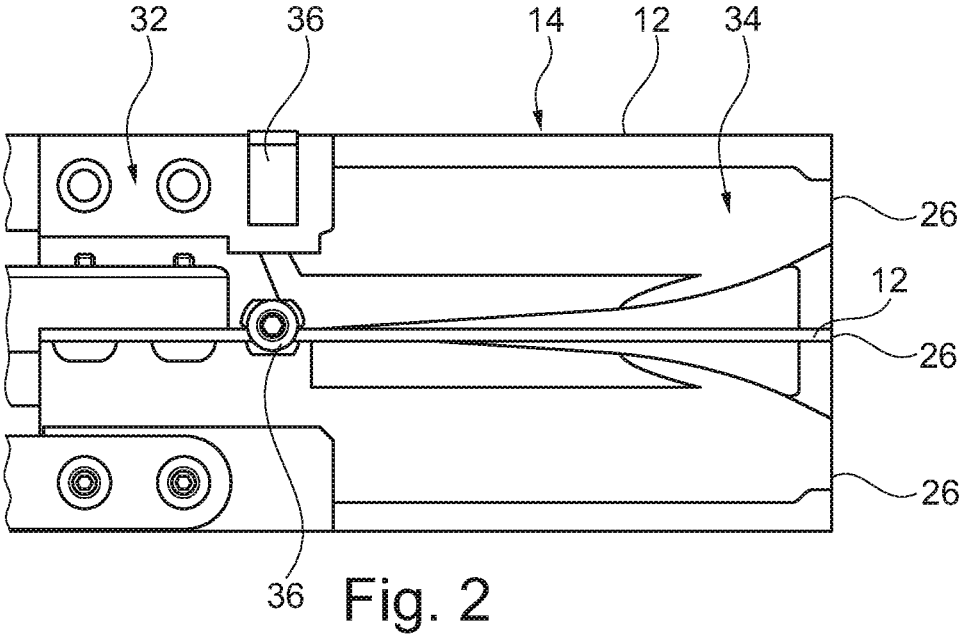
FIG. 2 schematically shows a side view of an antenna unit used in the antenna system according to FIG. 1.

In FIG. 2, the antenna unit 14 used by the antenna system 10 shown in FIG. 1 is illustrated in more detail in a side view. This figure reveals that the antenna system 10 comprises a feeding portion 32 as well as a radiation portion 34 wherein the latter one is assigned to the tips 26 of the antenna elements 12 that are connected with the lens unit 16 as shown in FIG. 1.

The feeding portion 32 comprises at least one terminal 36 for feeding the antenna elements 12 with electromagnetic waves to be radiated appropriately. As shown in FIGS. 1 and 2, each antenna element 12 may have its own terminal 36.

Generally, the relative electric permittivity of said lens unit 16 may be lower than 3, in some embodiments lower than 2.5, and other embodiments lower than 2.0, and in some other embodiments lower than 1.5.

Accordingly, an antenna system 10 is provided that has an improved radiation performance due to the fact that the lens unit 16 is directly attached to the antenna element(s) 12 via its lower side 22. This direct attachment and the shape of the lens unit 16, for example the shape of the upper side 20, ensure the improved electromagnetic properties of the whole antenna system 10, in particular the improved radiation characteristics.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. An antenna system, comprising:

at least one antenna element provided on a printed circuit board material; and a lens unit with a lens body made of a dielectric material, said lens unit being directly connected to said antenna element, said lens unit comprising a lower side facing said antenna element and an upper side being located opposite to said lower side, said upper side having at least one of a convex surface or a Fresnel lens shaped surface, said lens unit comprising at least one recess provided at said lower side of said lens unit, wherein said antenna element is at least partly inserted into said recess in a mounted state of said antenna system, wherein said upper side and said lower side are established by face sides of said lens unit, wherein said antenna element and said lens unit establish a push fit fitting as said lens unit is put over said antenna element via the lower side such that a tip of said antenna element is inserted in said recess.

2. The antenna system according to claim 1, wherein said lens unit is made in one piece.

3. The antenna system according to claim 1, wherein said recess is provided by a slot in said lens body.

4. The antenna system according to claim 3, wherein said slot extends through the whole lens body at said lower side.

5. The antenna system according to claim 3, wherein said lens body is dimensioned such that the contour of said lens body is substantially undisturbed by said slot and said antenna element filling said slot in said mounted state of said antenna system.

6. The antenna system according to claim 1, wherein said lower side comprises at least one of a convex surface or a Fresnel lens shaped surface.

7. The antenna system according to claim 6, wherein said lens unit is a bi-convex lens.

8. The antenna system according to claim 1, wherein the focal point of said lens unit is assigned substantially to the phase center of said antenna element in the mounted state.

9. The antenna system according to claim 1, wherein said lens body has a rounded circumference.

10. The antenna system according to claim 1, wherein said lens body has a polygonal contour.

11. The antenna system according to claim 1, wherein said lens unit is glued to said antenna element.

12. The antenna system according to claim 1, wherein the relative electric permittivity of said lens unit is lower than 3.

13. The antenna system according to claim 1, wherein said antenna system comprises two antenna elements being orthogonal to each other such that a dual-polarized antenna unit is provided.

14. The antenna system according to claim 13, wherein said lens unit comprises two slots at its lower side, said slots intersecting each other at an angle being substantially 90°.

15. The antenna system according to claim 13, wherein said lens unit is directly connected to both antenna elements.

16. The antenna system according to claim 1, wherein said antenna system is a tapered slotline antenna.

17. The antenna system according to claim 1, wherein said antenna system comprises a feeding portion and a radiation portion, said lower side being assigned to said feeding portion, said upper side being assigned to said radiation portion.

18. An antenna system, comprising:

at least one antenna element provided on a printed circuit board material; and a lens unit with a lens body made of a dielectric material, said lens unit being directly connected to said antenna element, said lens unit comprising a lower side facing said antenna element and an upper side being located opposite to said lower side, said upper side having at least one of a convex surface or a Fresnel lens shaped surface, said lens unit comprising at least one recess, said antenna element is at least partly inserted into said recess in a mounted state of said antenna system, wherein said lens unit comprises two slots at its lower side, said slots intersecting each other at an angle being substantially 90°.

19. An antenna system, comprising:

at least one antenna element provided on a printed circuit board material; and a lens unit with a lens body made of a dielectric material, said lens unit being directly connected to said antenna element, said lens unit comprising a lower side facing said antenna element and an upper side being located opposite to said lower side, said upper side having at least one of a convex surface or a Fresnel lens shaped surface, said lens unit comprising at least one recess, said antenna element is at least partly inserted into said recess in a mounted state of said antenna system, wherein said lens body is a solid body made of the dielectric material that is completely filled with the dielectric material without any cavities.

* * * * *